United States Patent [19]

Hindes

[11] 4,168,554

[45] Sep. 25, 1979

[54] CARDIOPULMONARY RESUSCITATION COT MATTRESS

[75] Inventor: Don W. Hindes, Greenfield, Ohio

[73] Assignee: Ferno-Washington, Inc., Wilmington, Ohio

[21] Appl. No.: 859,131

[22] Filed: Dec. 12, 1977

[51] Int. Cl.[2] ..... A47C 23/00; A61G 7/04

[52] U.S. Cl. ..... 5/446; 5/60

[58] Field of Search ..... 5/86, 91, 92, 317, 345 R, 5/351, 352

[56] References Cited

U.S. PATENT DOCUMENTS

| | | | |
|---|---|---|---|
| 3,148,389 | 9/1964 | Lustig | 5/345 R |
| 3,343,182 | 9/1967 | Waters | 5/92 |
| 3,534,417 | 10/1970 | Boyles | 5/345 R |
| 3,535,719 | 10/1970 | Murcot | 5/317 R |
| 4,074,375 | 2/1978 | Keller | 5/92 |

*Primary Examiner*—Casmir A. Nunberg

*Attorney, Agent, or Firm*—Frost & Jacobs

[57] ABSTRACT

A mattress of the type used on ambulance cots and similar patient transporting devices, the mattress having a cover containing patient supporting cushions, the cushion in the area of the patient's head and back overlying one or more stiffening panels which, upon removal of the overlying cushions, provide a firm support for the administration of cardiopulmonary resuscitation, the mattress preferably having an articulated head section which may be inclined relative to the back section to place the patient's head in a hyper-extended position.

12 Claims, 7 Drawing Figures

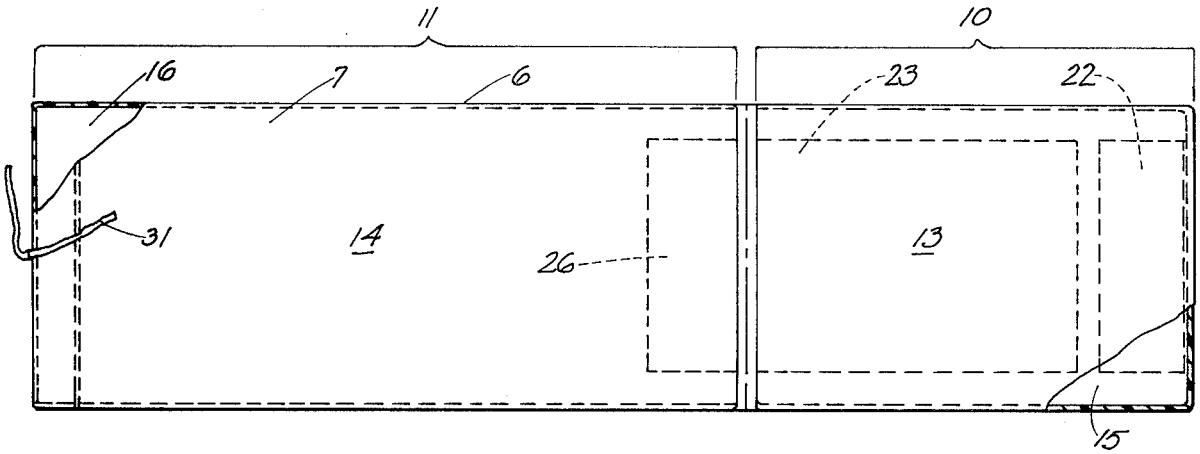
FIG 3
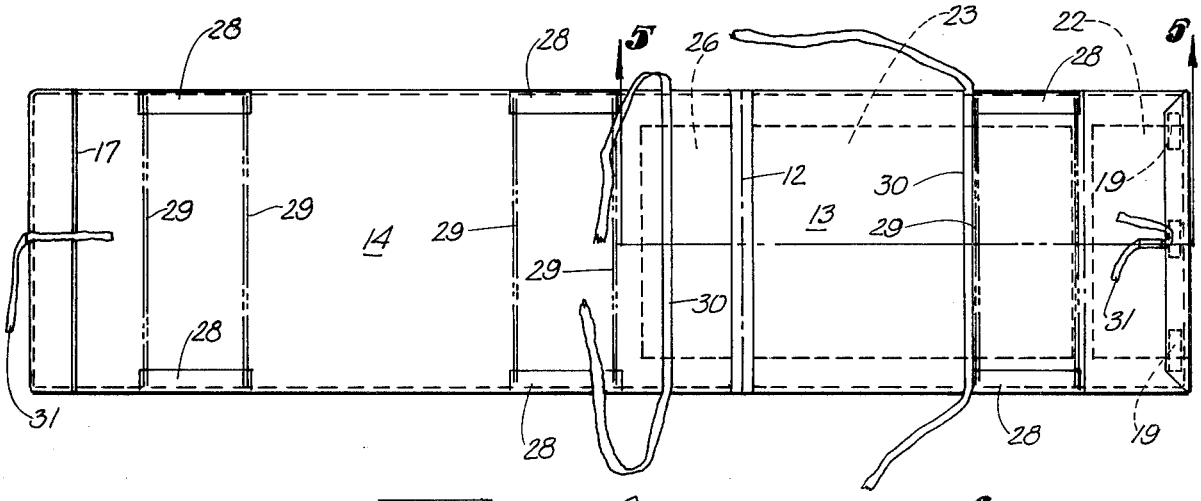
FIG 4
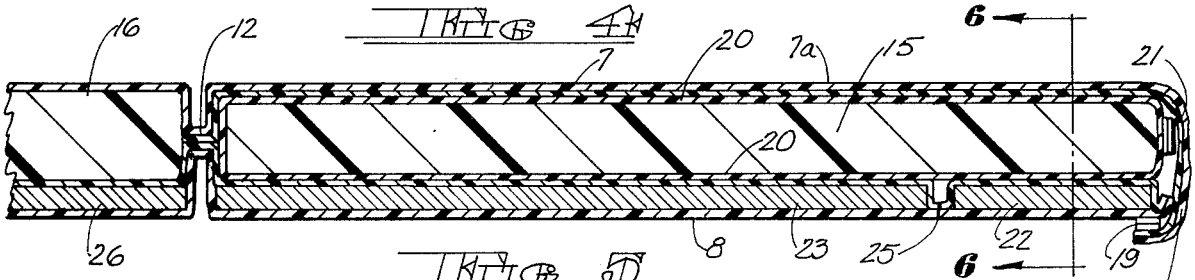
FIG 5
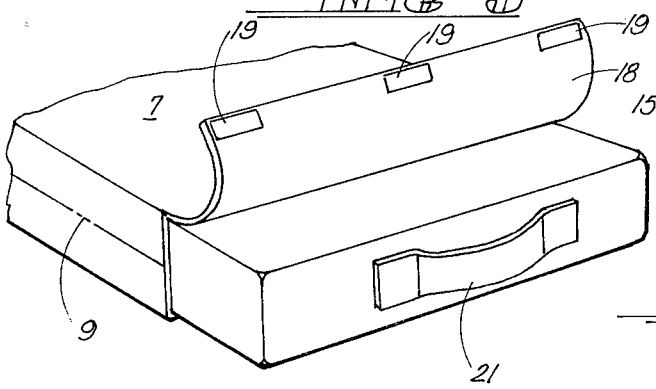
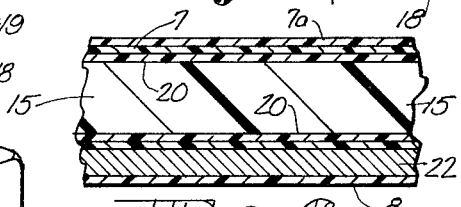
FIG 6
FIG 7

CARDIOPULMONARY RESUSCITATION COT MATTRESS

This invention relates to mattresses of the type used on ambulance cots and similar patient transporting devices, and has to do more particularly with an improved mattress construction capable of use for emergency cardiac compression and restoration of breathing.

BACKGROUND OF THE INVENTION

Cardiopulmonary resuscitation, generally referred to a C.P.R., is a widely utilized method for providing artificial circulation in a person with cardiac arrest. If the blood can be kept circulating by aritificial means and if it is supplied with oxygen by artificial ventilation, a person can be kept alive temporarily until the heart is restored to its function of pumping blood. Resuscitation efforts must be started within at least four to six minutes after circulation had stopped, otherwise brain damage will result.

Cardiopulmonary resuscitation involves restoration of breathing by artificial ventilation, such as mouth-to-mouth resuscitation, and the restoration of circulation by external cardiac compression. Cardiac compression involves the manual application of pressure to the patient's sternum in rhythmic fashion. Cardiac compression requires that the patient be placed on his back on a firm surface—never on a mattress or similar soft surface. Most ambulances and rescue units are equipped with special equipment, such as spine boards or C.P.R. boards which are designed to provide the necessary rigidity to support the patient during cardiopulmonary resuscitation.

Another important factor in cardiopulmonary resuscitation is to assure that the patient has a clear airway and that the throat is free from obstructions. To this end, it is desirable to place the patient's head in a hyperextended position, i.e., tilted backwards, so that the tongue is elevated, thereby opening the airway. Some C.P.R. boards incorporate a head receiving pocket which facilitates placing the patient's head in the proper position.

There are, however, certain disadvantages to the use of currently available spine boards and C.P.R. boards. Since cardiopulmonary resuscitation efforts should not be interrupted for any reason and should be continued even while the patient is being loaded into an ambulance or unloaded at the hospital, it is often difficult to transfer the patient to or from an ambulance cot. If the patient is lying on a cot at the time the cardiac arrest occurs, it becomes necessary to move the patient in order to insert the board, and valuable time may be lost in retrieving the board from its storage location and placing it beneath the patient. C.P.R. boards are essentially single use items, and constitute extra equipment which must be carried in the ambulance or rescue vehicle, where available space is often at a minimum.

The present invention deals with the provision of a cot mattress having general purpose usage, the construction of the mattress being such that it may be converted in an instant to meet C.P.R. requirements.

SUMMARY OF THE INVENTION

The present invention contemplates the provision of an ambulance cot mattress which, in normal use on a cot, has the usual attributes of a cot mattress, namely, a cover containing cushioning material, such as pads of foam rubber or other similar cushioning material for resiliently supporting the patient. However, in the areas of the mattress which support the head and back of the patient, the mattress is provided on its undersurface with rigidifying panels capable of performing the function of a C.P.R. board, the section of cushioning material overlying the panels being readily removable to substantially instantaneously convert the mattress into an effective C.P.R. device.

A mattress in accordance with the present invention is preferably of articulated construction having hinged head and back sections, the hinged head section being rotatable downwardly when the head section of the ambulance cot is unlocked, thereby providing for hyperventilation. In addition, the stiffener panels are so positioned that the patient may be placed on the mattress in either a supine or sitting position, which might be necessary if the patient has sustained other injuries requiring the patient to be transported in other than a supine position.

The mattress cover, which contains the cushioning pads and the stiffening panels, preferably has a top surface comprising vinyl leatherette and a bottom surface comprising a vinyl coated Nylon fabric provided with an inner liner of a urethane coated Nylon fabric which defines pockets in which the stiffening panels are enclosed and where they remain as an integral part of the mattress. In the head and body sections of the mattress, the cover, which also is preferably lined with urethane coated Nylon fabric, and the inner liner also define a cushion receiving pocket having a closure flap at the head end of the mattress, the pocket being adapted to removably receive a cushion of a length to extend throughout the head and back portions of the mattress, the cushion being enclosed in a flexible case also formed from a material such as urethane coated Nylon fabric, which is compatible with the inner surfaces of the mattress cover so that the cushion will readily slide relative to the pocket in the mattress cover, the cushion being provided at its head end with a handle strap by means of which it may be readily withdrawn from the pocket.

The flap which closes the head end of the mattress cover is preferably provided with Velcro fasteners which may be readily detached to provide rapid access to the enclosed cushion, and additionally the mattress cover is provided along its opposite sides with carrying straps so that the mattress may be used apart from its cot, the straps being positioned so that the patient may be carried on the mattress in either a prone or a sitting position. The mattress cover is also provided with restraining straps adapted to pass across the patient's body and fastened, thereby enabling the patient to be secured to the mattress and/or to the mattress cot.

Accordingly, a principal object of the invention is the provision of an improved cot mattress having the capability of serving as a C.P.R. device.

A further object of the invention is the provision of a cot mattress having integral stiffening panels which are normally covered by a patient supporting cushion, the cushion being readily removable to convert the mattress for C.P.R. usage.

Still a further object of the invention is the provision of a cot mattress, which when converted for C.P.R. use, provides the capability for inclining the patient's head for hyperventilation purposes.

Still a further object of the invention is the provision of a cot mattress having the capability for C.P.R. use, the mattress being capable of use either in association with a supporting cot or separately from the cot.

The foregoing objects, as well as others which will appear hereinafter or which will be apparent to the worker in the art upon reading this specification, are accomplished by the construction and arrangement of the parts which will be described in detail hereinafter.

DESCRIPTION OF THE DRAWINGS

FIG. 3 is a top plan view of a mattress in accordance with the invention.

FIG. 4 is a bottom plan view of the mattress.

FIG. 5 is an enlarged fragmentary sectional view taken along the line 5—5 of FIG. 4.

FIG. 6 is an enlarged fragmentary sectional view taken along the lines 6—6 of FIG. 5.

FIG. 7 is an enlarged fragmentary perspective view showing the cushion partially removed from the head end of the mattress cover.

DESCRIPTION OF THE PREFERRED EMBODIMENT

Figure 1:
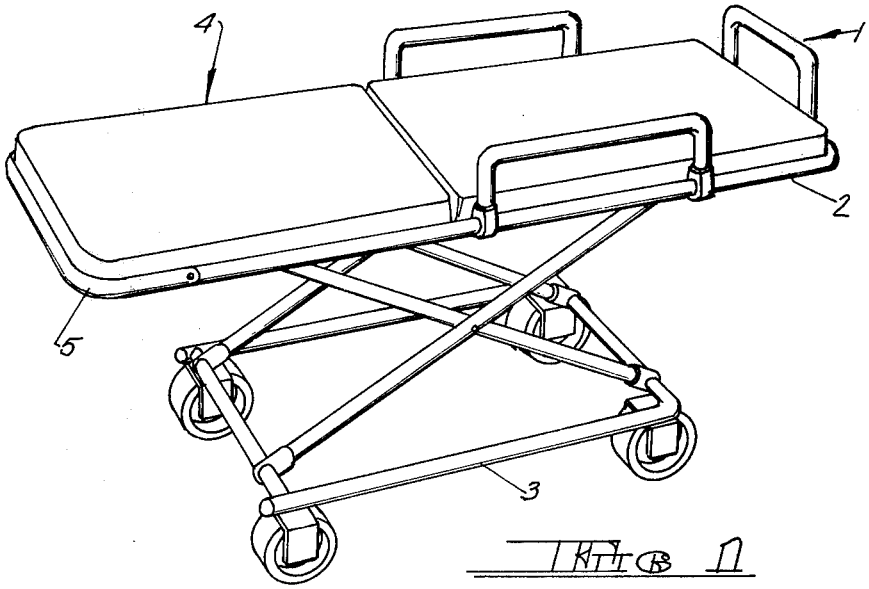
FIG. 1 is a perspective view of an ambulance cot mounting an improved mattress in accordance with the invention.

Referring first to FIG. 1, there is illustrated a conventional cot, indicated generally at 1, having a patient supporting frame 2 supporting a cot mattress 4. The cot frame illustrated has a pivoted head section 5 which may be raised or lowered as desired. It will be understood that the specific nature of the cot does not constitute a limitation on the invention, the mattress construction of the present invention being usable with diverse types of ambulance cots and stretchers having a patient supporting frame and mattress.

Conventional ambulance cot mattresses may be plain or articulated, i.e., they may be formed in one piece or they may be formed in articulated sections which will readily bend relative to each other, as where the mattress is utilized with cot structures which are adapted to selectively transport the patient in positions ranging from prone to seated. The essential feature of the present invention lies in the provision of a mattress the head and back sections of which can be readily converted from conventional cot usage to usage as a C.P.R. device, and it will be understood that the embodiment disclosed is non-limiting and exemplary of the conversion feature.

Referring to FIGS. 3 through 6 of the drawings, the mattress comprises a cover 6 which is of tubular or sleeve-like configuration, the cover having a top fabric 7 (seen in FIG. 3) and a bottom fabric 8 (seen in FIG. 4) the two surfaces preferably being formed from two pieces of material stitched together along their opposite side edges and along the foot end of the mattress, one such line of stitching being indicated at 9 in FIG. 6. While the top and bottom of the mattress cover may be formed from the same material, the top of the mattress cover is preferably formed from vinyl leatherette, whereas the bottom of the cover is formed from vinyl coated woven Nylon. It is also preferred to line the top of the cover with a urethane coated Nylon fabric, indicated at *7a*, since it is desirable, particularly in the area of the removable cushion, to have a low co-efficient of friction so that the cushion will move as freely as possible relative to the surrounding cover.

In the embodiment illustrated, the mattress is divided into an upper section 10 which supports the head and back of the patient, and a lower section 11 which support the remainder of the patient's body, the two sections being hingedly articulated relative to each other by one or more lines of stitching 12 passing through both the top and bottom surfaces of the cover, the cover thereby being divided into an upper compartment 13 and a lower compartment 14 each of which is adapted to receive a patient supporting cushion. Thus, the upper compartment 13 receives a foam rubber or the like cushion 15, and the lower compartment receives a similar cushion 16.

In the case of the lower cushion 16, it is essentially permanently installed within the cover, although it is preferred to provide a zipper 17 in the undersurface of the cover adjacent the foot end of the cover so that the cushion may be removed if desired. The cushion 15, on the other hand, must be quickly removed when it is desired to convert the mattress for C.P.R. usage. To accomplish rapid removal, the head eand of the mattress cover is provided with a flap extension 18, preferably formed as an integral extension of the top fabric 7, the extension being of a length to wrap around the head end of the mattress with the free side edge of the extension detachably connected to the marginal end edge of the bottom fabric 8. To this end, the flap extension is provided with mating Velcro fasteners 19 lying along the free side edge of the flap extension and the marginal end edge of the bottom 8, the flap extension thus normally closing the head end of the mattress so as to retain the cushion 15 therein, and yet the flap extension is readily openable to expose the enclosed cushion.

The cushion 15 itself is enclosed within a flexible casing 20 (best seen in FIGS. 5 and 6), preferably formed from a urethane coated Nylon fabric having a low co-efficient of friction, the cushion thus being capable of sliding relative to the cover. At its head end the cushion case 20 is provided with a strap-like flexible handle 21 by means of which the cushion may be readily withdrawn from the mattress cover.

In accordance with the invention, the upper section 10 of the cover is provided on its underside with stiffening panels 22 and 23, the stiffening panel 22 lying at the head end of the mattress so as to underlie the patient's head, with the stiffening panel 23 positioned to underlie the patient's back. Preferably, the stiffening panels are enclosed between the fabric 8 defining the bottom of the mattress cover and inner liner 24 seen in FIGS. 5 and 6, the inner liner also being formed from urethane coated Nylon fabric which is stitched around the periphery of the stiffening panels, such stitching being indicated at 25 in FIG. 5. In this connection, and as will be evident from FIGS. 3 and 4, the stiffening panels are preferably somewhat narrower than the width of the mattress cover.

The material from which the stiffening panels are formed does not constitute a limitation on the invention, although they are preferably non-metallic and must be sufficiently stiff and rigid for C.P.R. requirements, and the material should be such that if cracked or broken it will not produce sharp cutting edges. By way of non-limiting example, 300 lb. test carton board has been found to give excellent results when used as the stiffener panels.

While not mandatory for C.P.R. purposes, it has been found desirable to utilize an additional stiffener panel 26 in the lower section 11 of the mattress immediately adjacent the upper section 10, such panel underlying the corresponding portion of cushion 16. The stiffener panel 26 provides additional support for the mattress, particularly when the mattress is used as such to carry the patient in a sitting position.

The mattress is preferably provided with a series of carrying straps 28 (FIG. 4) stitched to bottom fabric 8 at spaced apart intervals along its opposite side edges, and to this end multiple lines of stitching 29 may be provided in the bottom fabric 8 extending across the cover between the opposite ends of the carrying straps to reinforce the bottom fabric 8 in the areas of the carrying handles. In addition, patient restraints 30 also may be provided to secure the patient to the mattress, and strap-like fasteners 31 are also preferably provided at the opposite ends of the mattress to facilitate its attachment to the cot frame. Such restraints and fasteners may be in the form of cloth ties, although preferably they will include Velcro fasteners to facilitate rapid attachment and detachment.

Figure 2:
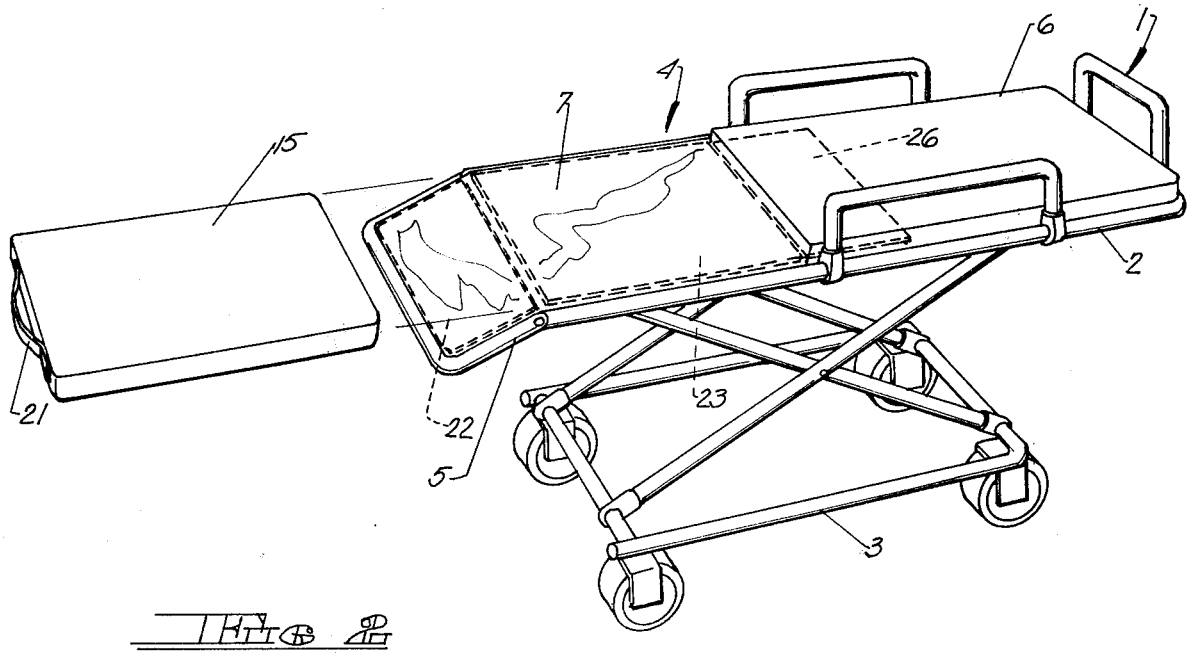
FIG. 2 is a perspective view similar to FIG. 1 illustrating the mattress with the cushion overlying the stiffening panels removed, the head portion of the mattress being inclined downwardly for hyperventilation purposes.

As should not be apparent, the instant invention provides a cot mattress which may be readily covered to provide an effective C.P.R. board. Not only does the removal of the cushion from the upper section of the mattress provide firm patient support on the underlying stiffening panels, the articulation between head panel 22 and adjoining panel 23 permits downward movement of the patient's head where hyperextension is required. Thus, as illustrated in FIG. 2, the head portion 5 of the cot frame may be released and lowered to the position illustrated, thereby lowering the stiffener panel 22 to the proper position to hyperextend the patient's head. Following use of the mattress for C.P.R. treatment of the patient, the removed cushion 15 may be readily reinserted in its pocket in the cover when it is desired to return the mattress to its normal condition of use.

Modifications may be made in the invention without departing from its spirit and purpose. Various such modifications have already been set forth and others will undoubtedly occur to the worker in the art upon reading this specification. For example, while certain preferred fabrics have been set forth, it will be evident that different combinations of fabrics may be utilized for the various components of the mattress. Accordingly, it is not intended that the invention shall be limited other than in the manner set forth in the claims which follow.

The embodiments of the invention in which an exclusive property or privilege is claimed are defined as follows:

1. A cot mattress comprising a mattress cover enclosing a cushion for normally supporting a patient, an essentially rigid stiffening panel in said cover underlying said cushion, said stiffening panel being supported directly by the underside of the mattress cover, and a reclosable opening in said cover through which said cushion may be removed, whereby to convert the cushioned mattress into a firm support for the administration of cardiopulmonary resuscitation upon removal of said cushion.

2. The cot mattress claimed in claim 1 including means for releasably closing the opening in said cover.

3. The cot mattress claimed in claim 2 wherein said cushion is enclosed in a casing having a handle strap for removing the cushion from the mattress cover.

4. The cot mattress claimed in claim 3 wherein said casing is formed from a material having a low coefficient of friction, and wherein said cover is lined with a material having a low coefficient of friction.

5. In a cot mattress having a cover enclosing a plurality of cushions, said cover being divided into an upper articulated section for supporting the head and back of a patient and a lower section for supporting the remainder of the patient's body, a pocket defined in the upper section of said cover for removably receiving a cushion therein, means for removably securing said cushion in said pocket, and a stiffening panel underlying said cushion and secured to said cover, whereby when said cushion is removed from said pocket, the patient's back will be supported on said stiffening panel to thereby provide a firm surface for the administration of cardiopulmonary resuscitation.

6. The cot mattress claimed in claim 5 wherein said pocket is defined by flexible material having a low coefficient of friction, and wherein said cushion is enclosed in a casing formed from flexible material having a low coefficient of friction.

7. The cot mattress claimed in claim 6 wherein the cushion casing has gripping means positioned to be grasped when it is desired to remove its cushion from its pocket.

8. The cot mattress claimed in claim 7 wherein said pocket is open at the head end of said mattress cover, wherein said mattress cover includes a closure flap for closing the open end of said pocket, and releasable fastening means for securing said closure flap in its closed position.

9. The cot mattress claimed in claim 5 wherein a pair of articulated stiffening panels underlie said pocket, a first of said panels being positioned to underlie the patient's head and the second of said panels being positioned to underlie the patient's back, whereby upon removal of said cushion, the first of said panels may be displaced angularly downwardly relative to said second panel so as to hyperextend the patient's head.

10. The cot mattress claimed in claim 5 including an additional stiffening panel in the lower section of the mattress, said additional stiffening panel lying beneath the cushion in the lower section of the mattress in the area immediately adjacent said upper secton.

11. The cot mattress claimed in claim 10 including a plurality of carrying straps secured along the opposite side edges of said mattress cover at spaced apart intervals to provide means for carrying said mattress.

12. The cot mattress claimed in claim 11 including patient restraining straps secured to the mattress cover at spaced apart intervals.

* * * * *